US006212903B1

(12) United States Patent
Okamoto et al.

(10) Patent No.: US 6,212,903 B1
(45) Date of Patent: Apr. 10, 2001

(54) AIR CONDITIONER

(75) Inventors: Takahiro Okamoto; Yukimasa Yano, both of Shiga; Masaya Shigenaga, Tokyo; Toshiyuki Natsume, Shiga, all of (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/381,241

(22) PCT Filed: Feb. 27, 1998

(86) PCT No.: PCT/JP98/00820

§ 371 Date: Sep. 17, 1999

§ 102(e) Date: Sep. 17, 1999

(87) PCT Pub. No.: WO98/41803

PCT Pub. Date: Sep. 24, 1998

(30) Foreign Application Priority Data

Mar. 17, 1997 (JP) ..... 9-084499

(51) Int. Cl.[7] ..... F25B 1/00
(52) U.S. Cl. ..... 62/498
(58) Field of Search ..... 62/119, 498; 252/67

(56) References Cited

U.S. PATENT DOCUMENTS 4,978,467 * 12/1990 Shankland et al. ..... 252/69

5,357,766 * 10/1994 Shiraishi et al. ..... 62/197

OTHER PUBLICATIONS

The Japanese Association of Refrigeration Jan. 20, 1988, p. 113.

L.D. Burns et al., vol. 72, No. 834 p. 369–374, Apr. 15, 1997.

Takashi Kaimi, et al., Refrigeration vol. 712, No. 820, Feb. 15, 1996.

* cited by examiner

*Primary Examiner*—Corrine McDermott
*Assistant Examiner*—Malik N. Drake
(74) *Attorney, Agent, or Firm*—Birch, Stewart, Kolasch & Birch, LLP

(57) ABSTRACT

A refrigerant circuit is formed by connecting an outdoor unit (5) and an indoor unit (6) to each other with communication piping (18) including a gas pipe (16) and a liquid pipe (17). An alternative refrigerant R-410A is used as a refrigerant to be circulated through the refrigerant circuit. For middle-sized and large-sized air conditioners whose rated cooling power (JIS C 9612) is not less than 4.0 kW, a gas pipe (16) having an outer diameter of about 9.5 mm (with wall thickness 0.8 mm) is used. For small-sized air conditioners whose rated cooling power (JIS C 9612) is less than 4.0 kW, a gas pipe (16) having an outer diameter of about 7.9 mm (with wall thickness 0.8 mm) is used.

5 Claims, 3 Drawing Sheets

AIR CONDITIONER

This application is the national phase under 35 U.S.C. §371 of PCT International Application No. PCT/JP98/00820 which has an International filing date of Feb. 27, 1998, which designated the United States of America.

TECHNICAL FIELD

The present invention relates to an air conditioner which uses an alternative refrigerant for a hydrochlorofluorocarbon base refrigerant HCFC-22, as a refrigerant that circulates through a refrigerant circuit.

BACKGROUND ART

Generally, an air conditioner comprises an outdoor unit equipped with a compressor, an outdoor heat exchanger, a pressure reducing mechanism and the like, and an indoor unit equipped with an indoor heat exchanger. The outdoor unit and the indoor unit are connected to each other with connection piping comprising a gas pipe, a liquid pipe or the like, and thereby a refrigerant circuit is formed between the outdoor unit and the indoor unit. In such an air conditioner, the refrigerant is circulated in the refrigerant circuit by driving the compressor, and thereby heat absorbed by the outdoor heat exchanger is released by the indoor heat exchanger so that heating operation is performed, or thereby heat absorbed by the indoor heat exchanger is released by the outdoor heat exchanger so that cooling operation is performed.

In this air conditioner, heat is transferred by means of the refrigerant as shown above, and thereby air conditioning operation is enabled. Therefore, the rate of refrigerant circulation expressed in refrigerant weight flowing per unit time needs to be increased or decreased depending on the air conditioning power of the equipment. However, when the refrigerant circulation rate is increased, leaving the gas pipe thickness as it is without changes would cause pressure loss due to the gas pipe to increase so that the air conditioning power would lower. On this account, in this air conditioner, the diameter of the gas pipe is changed according to the refrigerant circulation rate. For example, when HCFC-22 conventionally in common use is used as the refrigerant, gas pipes having a diameter of about 12.7 mm (hereinafter, referred to as "⅝-dia. pipe") is used in middle-sized and large-sized air conditioners whose refrigerant circulation rate is about 100 kg/h (kilogram per hour, likewise hereinafter) or about 150 kg/h or so. In small-sized air conditioners whose refrigerant circulation rate is about 60 kg/h or about 80 kg/h or so, gas pipes having a diameter of about 9.5 mm (hereinafter, referred to as "⅜-dia. pipe") are used. That is, it is a normal mode of application with use of HCFC-22 as the refrigerant that, a ⅝-dia. pipe is used as the aforementioned gas pipe in middle-sized and large-sized air conditioners whose rated cooling power is not less than 4.0 kW as defined by "JIS C 9612" of Japanese Industrial Standards, while a ⅜-dia. pipe is used as the gas pipe in small-sized air conditioners whose rated cooling power is less than 4.0 kW. Then, by changing the diameter of the gas pipe according to the air conditioning power of the air conditioner, a reduction in pressure loss is implemented in the middle-sized and large-sized air conditioners, and construction work is facilitated in the small-sized air conditioners. Besides, a cost reduction is implemented. It is noted that the cooling power as defined by "JIS C 9612" of Japanese Industrial Standards refers to a "quantity of heat (kW) that is removed in unit time from indoors when a room air conditioner is cooling operated".

In recent years, a demand for cost reduction to air conditioners and a demand for improvement in workability have been increasing more and more. In particular, the ⅝-dia. pipes are difficult to bend by hand in installation, which makes a cause of hindering the improvement in workability. However, only making the gas pipe smaller in diameter would cause occurrence of a problem that the pressure loss in the refrigerant circuit increases with the result of lowered air conditioning power.

Meanwhile, since HCFC-22 conventionally used as the refrigerant has become a target of fluorine regulation, alternative refrigerants substituting for HCFC-22 have begun to be discussed in various ways. However, there has been provided no alternative refrigerant that shows physical property values equivalent to or higher than the refrigerant HCFC-22 in all the aspects. Accordingly, which alternative refrigerant is appropriate for use is now under discussions, depending on the purpose of use.

DISCLOSURE OF THE INVENTION

The present invention having been achieved to solve these and other disadvantages of the prior art, an object of the invention is to implement cost reduction as well as workability enhancement while avoiding any decrease in the air conditioning power.

In order to achieve the above object, the present invention provides an air conditioner in which a refrigerant circuit is formed by connecting an outdoor unit and an indoor unit to each other with communication piping including a gas pipe and a liquid pipe, and in which a hydrofluorocarbon base refrigerant R-410A is circulated through the refrigerant circuit so that air conditioning operation is performed, wherein cooling power is substantially not less than 4 kW, and the gas pipe has an outer diameter of substantially 9.5 mm and a wall thickness of substantially 0.8 mm.

With this constitution, the air conditioner is a middle-sized or large-sized air conditioner having a cooling power of substantially not less than 4 kW, and the gas pipe has an outer diameter of substantially 9.5 mm and a wall thickness of substantially 0.8 mm, thus smaller in diameter than gas pipes commonly used when the hydrochlorofluorocarbon base refrigerant HCFC-22 is used. Therefore, it becomes possible to work by hand with the communication piping comprising the gas pipe, the liquid pipe and the like, so that the workability enhancement is achieved. Further, cost reduction is achieved with the downsizing of the gas pipe. In this case, the hydrofluorocarbon base refrigerant R-410A large in volumetric power than the HCFC-22 is used as the refrigerant to be circulated through the refrigerant circuit, so that any increase in pressure loss due to the diameter reduction of the gas pipe is suppressed and that temperature loss due to the pressure loss is reduced.

Consequently, according to this invention, further cost reduction and workability enhancement are achieved while decrease in the air conditioning power is avoided.

Also, the present invention provides an air conditioner in which a refrigerant circuit is formed by connecting an outdoor unit and an indoor unit to each other with communication piping including a gas pipe and a liquid pipe, and in which a hydrofluorocarbon base refrigerant R-410A is circulated through the refrigerant circuit so that air conditioning operation is performed, wherein cooling power is substantially less than 4 kW, and the gas pipe has an outer diameter of substantially 7.9 mm and a wall thickness of substantially 0.8 mm.

With this constitution, the air conditioner is a small-sized air conditioner having a cooling power of substantially less than 4 kW, and the gas pipe has an outer diameter of substantially 7.9 mm and a wall thickness of substantially 0.8 mm, thus smaller in diameter than gas pipes commonly used when the hydrochlorofluorocarbon base refrigerant HCFC-22 is used. Therefore, it becomes possible to achieve workability enhancement and cost reduction. In this case, the refrigerant R-410A larger in volumetric power than the HCFC-22 is used as the refrigerant to be circulated through the refrigerant circuit, so that increase in pressure loss due to the diameter reduction of the gas pipe is suppressed and that temperature loss due to the pressure loss is reduced. Thus, any decrease in air conditioning power is avoided.

Also, the present invention provides an air conditioner in which a refrigerant circuit is formed by connecting an outdoor unit and an indoor unit to each other with communication piping including a gas pipe and a liquid pipe, and in which an alternative refrigerant substitutive for HCFC-22 is circulated through the refrigerant circuit so that air conditioning operation is performed, wherein the alternative refrigerant is R-410A, and a gas pipe forming part of the communication piping is smaller in diameter than a gas pipe which is used in a normal mode of application with use of the HCFC-22 as the refrigerant.

With this constitution, R-410A is used as the refrigerant to be circulated through the refrigerant circuit, while the gas pipe is made smaller in diameter than gas pipes which are used in a normal mode of application with the use of HCFC-22. This R-410A is equivalent to HCFC-22 in terms of air conditioning power for refrigerant circulation rate as shown in FIG. 4. Its volumetric power is about 140 on the basis that HCFC-22's is assumed as 100. Therefore, for air conditioners having the same air conditioning power, increases in pressure loss is avoided even when the gas pipe to be used is smaller in diameter than that for HCFC-22. Consequently, according to the present invention, further cost reduction and workability enhancement are achieved while decreases in the air conditioning power is avoided.

Further, in an embodiment, the air conditioner is characterized in that rated cooling power as defined in "JIS C 9612" of Japanese Industrial Standards is not less than 4.0 kW and the gas pipe has a diameter of about 9.5 mm.

With this constitution, for middle-sized and large-sized air conditioners, it becomes possible to achieve cost reduction and workability enhancement without decreasing the air conditioning power. In particular, using a 9.5 mm-dia. gas pipe makes it possible to do manual bending work even with the middle-sized and large-sized air conditioners, so that the workability is even further enhanced.

Furthermore, in an embodiment, the air conditioner is characterized in that rated cooling power as defined in "JIS C 9612" of Japanese Industrial Standards is less than 4.0 kW and the gas pipe has a diameter of about 7.9 mm.

With this constitution, for small-sized air conditioners, it becomes possible to achieve cost reduction as well as workability enhancement without decreasing the air conditioning power.

BEST MODE FOR CARRYING OUT THE INVENTION

Figure 1A:
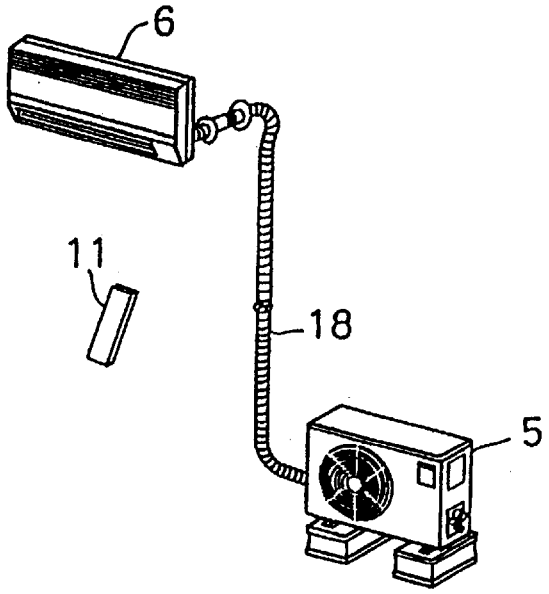
FIG. 1 is a schematic arrangement views showing an example of the air conditioner according to the present invention.
Figure 1B:
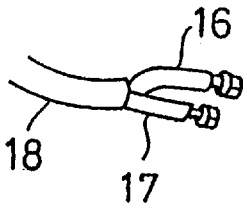
Figure 2:
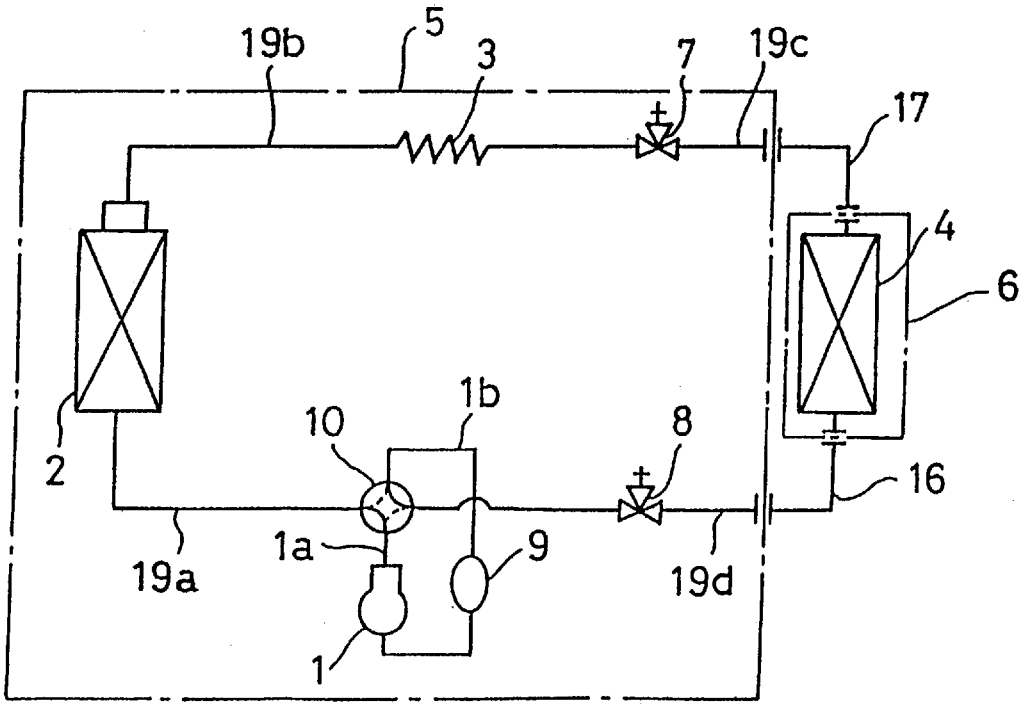
FIG. 2 is a refrigerant circuit diagram in the air conditioner shown in FIG. 1.

FIG. 1 is a schematic arrangement views of an air conditioner which is an embodiment of the present invention. FIG. 2 is a diagram showing a refrigerant circuit of the air conditioner. As shown in FIGS. 1A and 2, this air conditioner comprises an outdoor unit 5 internally equipped with a compressor 1, an outdoor heat exchanger 2 and a capillary tube 3 (or motor-operated valve), and an indoor unit 6 internally equipped with an indoor heat exchanger 4. The outdoor unit 5 and the indoor unit 6 are connected to each other with communication piping 18 including a gas pipe 16 and a liquid pipe 17 as shown in FIG. lB, and thereby a refrigerant circuit is formed, as shown in FIG. 2. In addition, reference numeral 11 denotes an indoor remote control to be used for a user to control the air conditioner.

As shown in FIG. 2, in this air conditioner, a discharge pipe 1*a* and a suction pipe 1*b* of the compressor 1 are connected to a four-path switching valve 10, and to this four-path switching valve 10 are connected the outdoor heat exchanger 2, the capillary tube 3 and the indoor heat exchanger 4 in a loop form sequentially with a first gas pipe 19*a*, a first liquid pipe 19*b*, a second liquid pipe 19*c* and a second gas pipe 19*d*. Then, part of the second liquid pipe 19*c* is formed by the liquid pipe 17 of the communication piping 18. Also, part of the second gas pipe 19*d* is formed by the gas pipe 16 of the communication piping 18. In addition, reference numeral 9 denotes an accumulator provided with a view to preventing liquid compression in the compressor 1. Further, reference numeral 7 denotes a liquid closing valve and 8 denotes a gas closing valve, each of the valves being provided with a view to preventing refrigerant leakage in piping work.

In this air conditioner, heating operation or cooling operation is performed based on a command from the remote control 11. For the heating operation, the four-path switching valve 10 is switched to the state of broken line shown in FIG. 2, so that the refrigerant is circulated from the compressor 1 sequentially to the indoor heat exchanger 4 to the capillary tube 3 (or motor-operated valve) and to the outdoor heat exchanger 2, causing the indoor heat exchanger 4 to function as a condenser and also causing the outdoor heat exchanger 2 to function as an evaporator. Then, heat absorbed by the outdoor heat exchanger 2 is released into the room via the refrigerant so that the temperature inside the room is increased, and thereby heating operation is effected. For the cooling operation, on the other hand, the four-path switching valve 10 is switched to the state of solid line shown in FIG. 2, and thereby the refrigerant is circulated in the opposite direction to that of the heating operation, causing the indoor heat exchanger 4 to function as an evaporator and causing the outdoor heat exchanger 2 to function as a condenser. Then, heat absorbed in the room is released out of the room via the refrigerant so that the temperature inside the room is decreased, and thereby cooling operation is effected.

As the refrigerant to be circulated through the refrigerant circuit, an alternative refrigerant R-410A to substitute for the hydrochlorofluorocarbon base refrigerant HCFC-22 is used. This alternative refrigerant R-410A is a mixed refrigerant in which hydrofluorocarbon base refrigerants HFC-32 and HFC-125 are mixed at a ratio of 50:50, and has an ozonosphere destruction factor (ODP) of "0" (UNEP Synthesis Report 1991) and therefore is usable as an alternative refrigerant for HCFC-22. This alternative refrigerant R-410A is one of those superior as an alternative refrigerant also in being a pseudo-azeotropic refrigerant while being a mixed refrigerant, in being nonflammable, in being extremely low in toxicity and the like.

Figure 4:
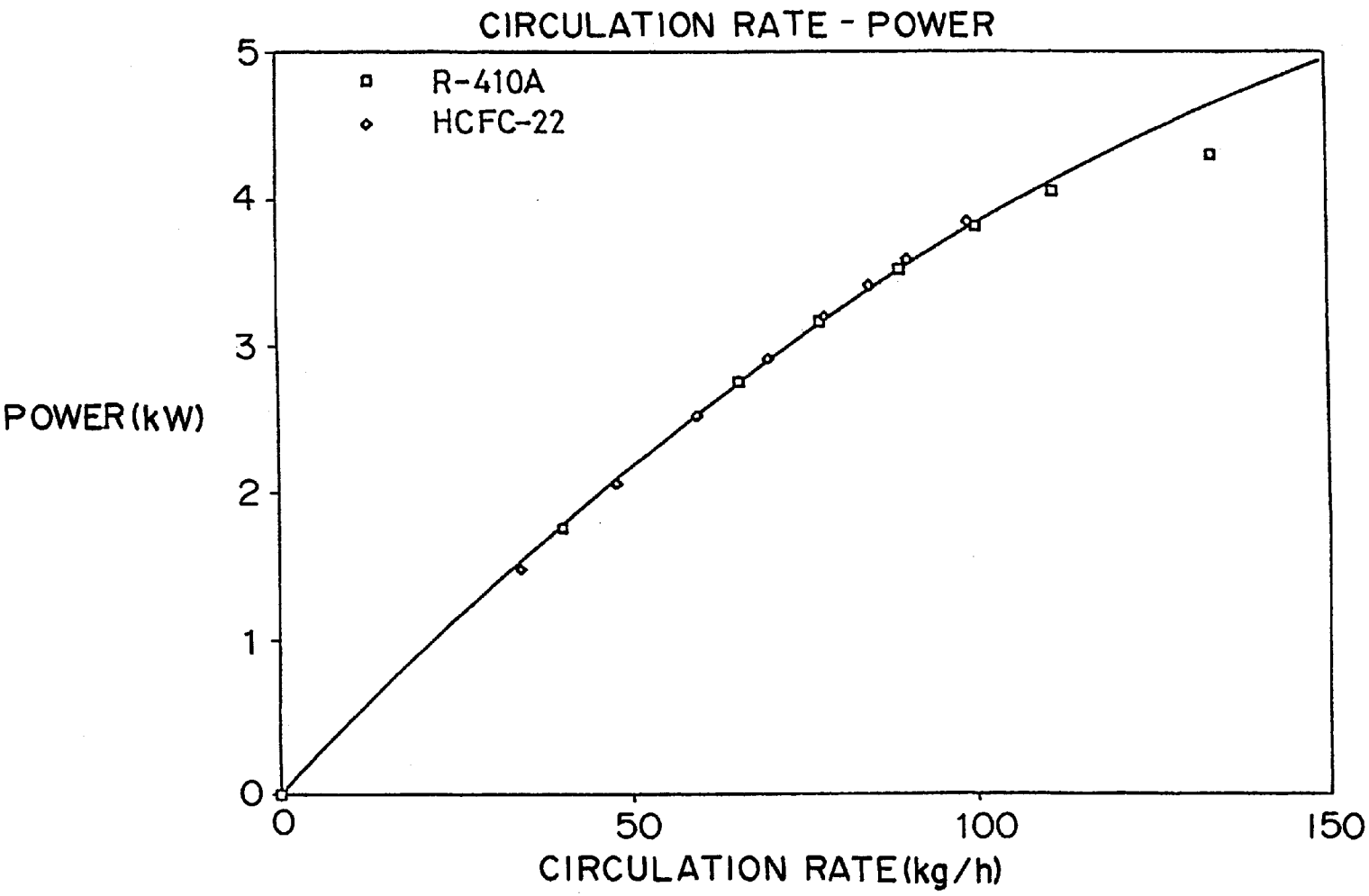
FIG. 4 is a graph showing the relation between circulation rate and air conditioning power with respect to the alternative refrigerant R-410A and the refrigerant HCFC-22.

FIG. 4 shows the relation between circulation rate and air conditioning power with respect to the refrigerant HCFC-22 and its alternative refrigerant R-410A. As shown in FIG. 4, the refrigerant HCFC-22 and the alternative refrigerant R-410A are generally equivalent to each other in air conditioning power for various refrigerant circulation rates. Accordingly, for air conditioners having the same air conditioning power, the refrigerant circulation rate does not need to be changed between a case in which the refrigerant HCFC-22 is used and another case in which the alternative refrigerant R-410A is used.

Figure 3:
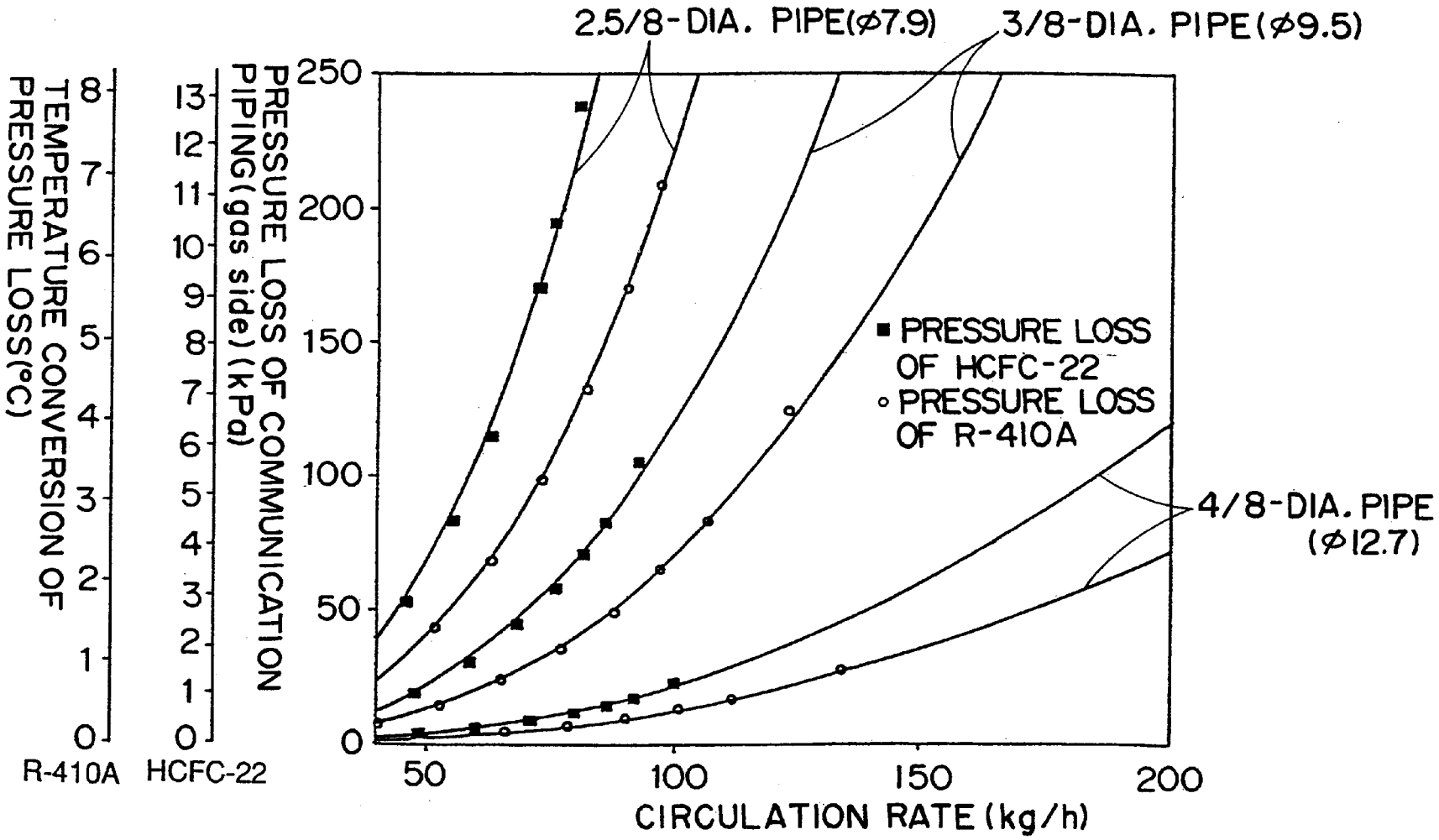
FIG. 3 is a graph showing the relation between refrigerant circulation rate and pressure loss as well as the relation between circulation rate and temperature conversion of pressure loss with respect to various gas pipe diameters.

FIG. 3 is a graph showing the relation between refrigerant circulation rate and pressure loss as well as the relation between circulation rate and temperature conversion of pressure loss with the use of gas pipes of different diameters. In this case, outer diameters of 2.5/8-dia., ⅜-dia., ⅝-dia. pipes used to determine those relations are 7.9 mm (2.5/8 inch), 9.5 mm (⅜ inch) and 12.7 mm (⅝ inch), respectively, and their wall thickness is 0.8 mm and length is 5 m. In addition, measurement of the above relations was performed with a gaseous refrigerant.

As shown in FIG. 3, with the same refrigerant circulation rate, the alternative refrigerant R-410A shows a smaller pressure loss than the refrigerant HCFC-22. This is because, on the basis that volumetric power of the refrigerant HCFC-22 is 100, volumetric power of the alternative refrigerant R-410A is about 140, higher than that of the refrigerant HCFC-22, as described above, so that with the same refrigerant circulation rate, use of the alternative refrigerant R-410A results in a smaller volume than use of the refrigerant HCFC-22. Also, in a comparison of temperature conversion of pressure loss between the refrigerant HCFC-22 and the alternative refrigerant R-410A, for the same pressure loss (e.g., 150 kPa), the temperature conversion value (e.g., 5° C.) of pressure loss of the alternative refrigerant R-410A is lower than the temperature conversion value (e.g., 8° C.) of pressure loss of the refrigerant HCFC-22. Consequently, even with the same pressure loss, the alternative refrigerant R-410A is smaller in temperature loss due to pressure loss than the refrigerant HCFC-22.

Therefore, in this embodiment, when the air conditioner is a middle-sized or large-sized air conditioner having a rated cooling power (JIS C 9612) of not less than 4.0 kW, i.e., for example when the refrigerant circulation rate is about 100 kg/h or about 150 kg/h or so, a ⅜-dia. pipe having an outer diameter of about 9.5 mm is used as the gas pipe 16 of the communication piping 18. Also, when the air conditioner is a small-sized air conditioner having a rated cooling power (JIS C 9612) of less than 4.0 kW, i.e., for example when the refrigerant circulation rate is about 60 kg/h or about 80 kg/h or so, a 2.5/8-dia. pipe having an outer diameter of about 7.9 mm is used as the gas pipe 16 of the communication piping 18. In addition, that the rated cooling power is less than 4.0 kW means that the cooling power according to Attachment 1 of "JIS C 9612-1994" of Japanese Industrial Standards is less than 3.8 kW for practical use.

In the air conditioner constituted as described above, the gas pipe 16 of the communication piping 18 is smaller in diameter than the gas pipe (⅝-dia. pipe in the middle-sized and large-sized air conditioners, and ⅜-dia. pipe in small-sized air conditioners) to be used in a normal mode of application when the hydrochlorofluorocarbon base refrigerant HCFC-22 is used as the refrigerant. Therefore, the workability for field installation work or the like is even more enhanced. Also, a total cost reduction becomes achievable with the size reduction of the gas pipe 16. In particular, even in middle-sized and large-sized air conditioners with the rated cooling power (JIS C 9612) beyond 4.0 kW, a ⅜-dia. pipe is used to constitute the air conditioner, enabling manual bending work of the communication piping 18, so that the workability for middle-sized and large-sized air conditioners is further enhanced. Still, because the alternative refrigerant R-410A to be used as the refrigerant is larger in volumetric power than the refrigerant HCFC-22, there occurs no considerable increase in pressure loss even if the gas pipe 16 is reduced in diameter as shown above. Further, the alternative refrigerant R-410A is lower in temperature conversion value of pressure loss and smaller in temperature loss due to pressure loss than the refrigerant HCFC-22. By those advantages described above, according to this embodiment, any decrease in air conditioning power is avoided.

INDUSTRIAL APPLICABILITY

The air conditioner of the present invention, in which an alternative refrigerant substitutive for the hydrochlorofluorocarbon base refrigerant HCFC-22 is used as the refrigerant to be circulated through the refrigerant circuit, is capable of achieving improvement in workability as well as further reduction in cost while avoiding any decrease in air conditioning power.

What is claimed is:

1. An air conditioner in which a refrigerant circuit is formed by connecting an outdoor unit and an indoor unit to each other with communication piping including a gas pipe and a liquid pipe, and in which a hydrofluorocarbon base refrigerant R-410A is circulated through the refrigerant circuit so that air conditioning operation is performed, wherein cooling power is not less than 4 kW, and the gas pipe has an outer diameter of approximately 9.5 mm and a wall thickness of approximately 0.8 mm.

2. An air conditioner in which a refrigerant circuit is formed by connecting an outdoor unit and an indoor unit to each other with communication piping including a gas pipe and a liquid pipe, and in which a hydrofluorocarbon base refrigerant R-410A is circulated through the refrigerant circuit so that air conditioning operation is performed, wherein cooling power is less than 4 kW, and the gas pipe has an outer diameter of approximately 7.9 mm and a wall thickness of approximately 0.8 mm.

3. An air conditioner in which a refrigerant circuit is formed by connecting an outdoor unit and an indoor unit to each other with communication piping including a gas pipe and a liquid pipe, and in which an alternative refrigerant substitutive for HCFC-22 is circulated through the refrigerant circuit so that air conditioning operation is performed, wherein the alternative refrigerant is R-410A, and a gas pipe forming part of the communication piping is smaller in diameter than a gas pipe which is used in a normal mode of application with use of the HCFC-22 as the refrigerant.

4. The air conditioner according to claim 3, wherein rated cooling power as defined in "JIS C 9612" of Japanese Industrial Standards is not less than 4.0 kW and the gas pipe has a diameter of about 9.5 mm.

5. The air conditioner according to claim 3, wherein rated cooling power as defined in "JIS C 9612" of Japanese Industrial Standards is less than 4.0 kW and the gas pipe has a diameter of about 7.9 mm.

* * * * *